US006752108B2

(12) United States Patent
Katayama

(10) Patent No.: US 6,752,108 B2
(45) Date of Patent: Jun. 22, 2004

(54) FOUR-CYCLE ENGINE FOR MARINE DRIVE

(75) Inventor: Goichi Katayama, Shizuoka (JP)

(73) Assignee: Yamaha Marine Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 09/870,618

(22) Filed: May 31, 2001

(65) Prior Publication Data

US 2002/0043232 A1 Apr. 18, 2002

(30) Foreign Application Priority Data

May 31, 2000 (JP) ..... 2000-163383

(51) Int. Cl.[7] ..... F01L 1/34

(52) U.S. Cl. ..... 123/90.17; 123/90.15; 74/568 R

(58) Field of Search ..... 123/90.15, 90.17, 123/90.16, 90.31; 74/568 R; 464/1, 2, 160; 92/121, 122

(56) References Cited

U.S. PATENT DOCUMENTS

| | | | | |
|---|---|---|---|---|
| 4,476,823 A | * | 10/1984 | Williams | 123/90.12 |
| 5,012,773 A | | 5/1991 | Akasaka et al. | |
| 5,058,539 A | | 10/1991 | Saito et al. | |
| 5,063,895 A | * | 11/1991 | Ampferer | 123/196 R |
| 5,111,780 A | | 5/1992 | Hannibal | |

(List continued on next page.)

FOREIGN PATENT DOCUMENTS

| | | |
|---|---|---|
| DE | 3613945 A1 | 10/1986 |
| EP | 0 356 162 | 8/1989 |
| EP | 0 452 671 A2 | 10/1991 |
| EP | 0 583 584 A1 | 2/1994 |
| EP | 0 699 831 A2 | 8/1995 |
| EP | 0 808 997 A1 | 5/1997 |
| EP | 0 829 621 A2 | 9/1997 |
| EP | 0 834 647 A1 | 4/1998 |

*Primary Examiner*—Thomas Denion
*Assistant Examiner*—Jaime Corrigan
(74) *Attorney, Agent, or Firm*—Knobbe, Martens, Olson & Bear, LLP.

(57) ABSTRACT

A four-cycle engine for a marine drive includes an improved construction. The engine has an air induction device for introducing air to a combustion chamber. The air induction device defines an intake port next to the combustion chamber. An intake valve is movable between open and closed positions of the intake port. A valve actuator is journaled on the engine body for rotation to actuate the intake valve at a set angular position. A variable valve timing (VVT) mechanism is arranged to set the valve actuator to the angular position between advanced and delayed angular positions. A dedicated oil pump supplies pressurized oil to an oil control valve, which regulates and controls the VVT mechanism. A lubricant oil pump supplies pressurized oil to an engine lubrication system.

22 Claims, 16 Drawing Sheets

U.S. PATENT DOCUMENTS 5,133,310 A 7/1992 Hitomi et al.
5,143,034 A 9/1992 Hirose
5,150,675 A 9/1992 Murata
5,184,578 A 2/1993 Quinn, Jr. et al.
5,184,581 A 2/1993 Aoyama et al.
5,189,999 A 3/1993 Thoma
5,289,805 A 3/1994 Quinn, Jr. et al.
5,301,639 A 4/1994 Satou
5,305,718 A 4/1994 Muller
5,353,755 A 10/1994 Matsuo et al.
5,458,099 A 10/1995 Koller et al.
5,460,130 A 10/1995 Fukuzawa et al.
5,474,038 A 12/1995 Golovatai-Schmidt et al.
5,540,197 A 7/1996 Golovatai-Schmidt et al.
5,592,907 A 1/1997 Hasebe et al.
5,606,941 A 3/1997 Trzmiel et al.
5,669,343 A 9/1997 Adachi
5,704,315 A 1/1998 Tsuchida et al.
5,713,319 A 2/1998 Tortul
5,718,196 A 2/1998 Uchiyama et al.
5,722,356 A 3/1998 Hara
5,769,044 A * 6/1998 Moriya ..... 123/90.17
5,797,363 A 8/1998 Nakamura
5,799,631 A 9/1998 Nakamura
5,816,204 A 10/1998 Moriya et al.
5,829,399 A 11/1998 Scheidt et al.
5,855,190 A * 1/1999 Matsunaga ..... 123/90.17
5,899,181 A * 5/1999 Kurata et al. ..... 123/90.17
5,903,215 A * 5/1999 Kanno ..... 340/450.3
5,924,396 A 7/1999 Ochiai et al.
5,951,344 A * 9/1999 Tsunoda et al. ..... 123/572
6,032,629 A 3/2000 Uchida
6,035,817 A 3/2000 Uchida
6,076,492 A 6/2000 Takahashi
6,129,060 A 10/2000 Koda
6,186,104 B1 2/2001 Torii et al.
6,202,610 B1 * 3/2001 Yoshiki et al. ..... 123/90.15
6,234,125 B1 * 5/2001 Neubauer et al. ..... 123/90.17

* cited by examiner

FOUR-CYCLE ENGINE FOR MARINE DRIVE

PRIORITY INFORMATION

This application is based on and claims priority to Japanese Patent Application No. 2000-163383, filed May 31, 2000, the entire contents of which are hereby expressly incorporated by reference.

BACKGROUND OF THE INVENTION

1. Field of the Invention

This invention relates to a four-cycle engine for a marine drive, and more particularly to a four-cycle engine that includes a variable valve timing mechanism.

2. Description of Related Art

A typical outboard motor comprises a power head and a housing unit depending from the power head. The power head includes an internal combustion engine that drives a marine propulsion device such as a propeller through a driveshaft and a propulsion shaft both journaled on the housing unit. The marine propulsion device is attached to the end of the housing unit and is in a submerged position during operation.

Four-cycle internal combustion engines tend to have advantageous emission control and high performance relative to two-cycle internal combustion engines. Accordingly, it is becoming popular for marine drives such as outboard motors to employ such four-cycle internal combustion engines. Typically, the four-cycle engine has intake and exhaust ports, both of which communicate with a combustion chamber. One or more camshafts are often provided to actuate the intake and exhaust valves between an open position and a closed position at proper timing so that air is introduced into the combustion chamber and exhaust gases are discharged therefrom. Automobile engines often include a variable valve timing mechanism that can advantageously change the opening and closing timing of the valves depending on certain operating conditions, such as engine speed. The valve timing usually is advanced at high engine speeds to ensure high charging efficiency and high performance. Valve timing usually is delayed at low engine speeds to ensure high combustion efficiency, fuel economy and good emission control.

Typically, the variable valve timing mechanism is driven by hydraulic pressure. Often the hydraulic pressure is supplied by an existing lubricant oil pump that circulates lubricant oil through the engine. Typically, oil that has been pressurized by the oil pump is directed into one of two pathways. One pathway leads to the engine body to lubricate components of the engine; another pathway leads to an oil control valve and a variable valve timing (VVT) mechanism. The oil control valve controls the delivery of oil to the VVT mechanism in order to control the mechanism. A problem arises because the relatively long passage from the lubricant oil pump to the oil control valve results in delayed responsiveness. Thus, the hydraulic pressure to the VVT mechanism cannot be adequately stabilized and performance of the VVT mechanism suffers.

A need therefore exists for an improved four-cycle engine for a marine drive having a variable valve timing mechanism that has improved responsiveness and improved hydraulic stability.

SUMMARY OF THE INVENTION

In accordance with one aspect, the present invention includes a four-cycle engine comprising an engine body, at least one cylinder, a piston reciprocatingly arranged in the cylinder, and a cylinder head assembly. A combustion chamber is defined between the cylinder head assembly, cylinder and piston. A port opens into the combustion chamber, and a valve selectively opens and closes the port. A camshaft has a cam configured to actuate the valve. A variable valve timing mechanism is configured to vary the valve timing of the valve by varying an angular position of the camshaft. A fluid pump is adapted to provide fluid under pressure to a control valve. The control valve is configured to selectively supply fluid to the variable valve timing mechanism so as to control the angular position of the camshaft. An engine lubrication system has an oil reservoir and an oil pump. The oil pump draws oil from the oil reservoir.

In accordance with another aspect of the invention, a four-cycle engine comprises an engine body defining at least one cylinder having a piston arranged to reciprocate therein, and a cylinder head attached to the engine body. A combustion chamber is defined between the cylinder, piston and cylinder head. A port opens into the combustion chamber, and a valve mechanism is configured to selectively open and close the port. A camshaft having a cam lobe is configured to actuate the valve mechanism. A variable valve timing mechanism cooperates with the camshaft, and is configured to selectively vary the angular position of the camshaft in response to hydraulic fluid inputs supplied by a driving system. The driving system comprises a hydraulic fluid pump and a control valve. A lubrication system is configured to supply lubricant oil to the engine body. The lubrication system comprises an oil pump and an oil reservoir.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise 16 figures.

DETAILED DESCRIPTION OF THE PREFERRED EMBODIMENTS OF THE INVENTION

Figure 1:
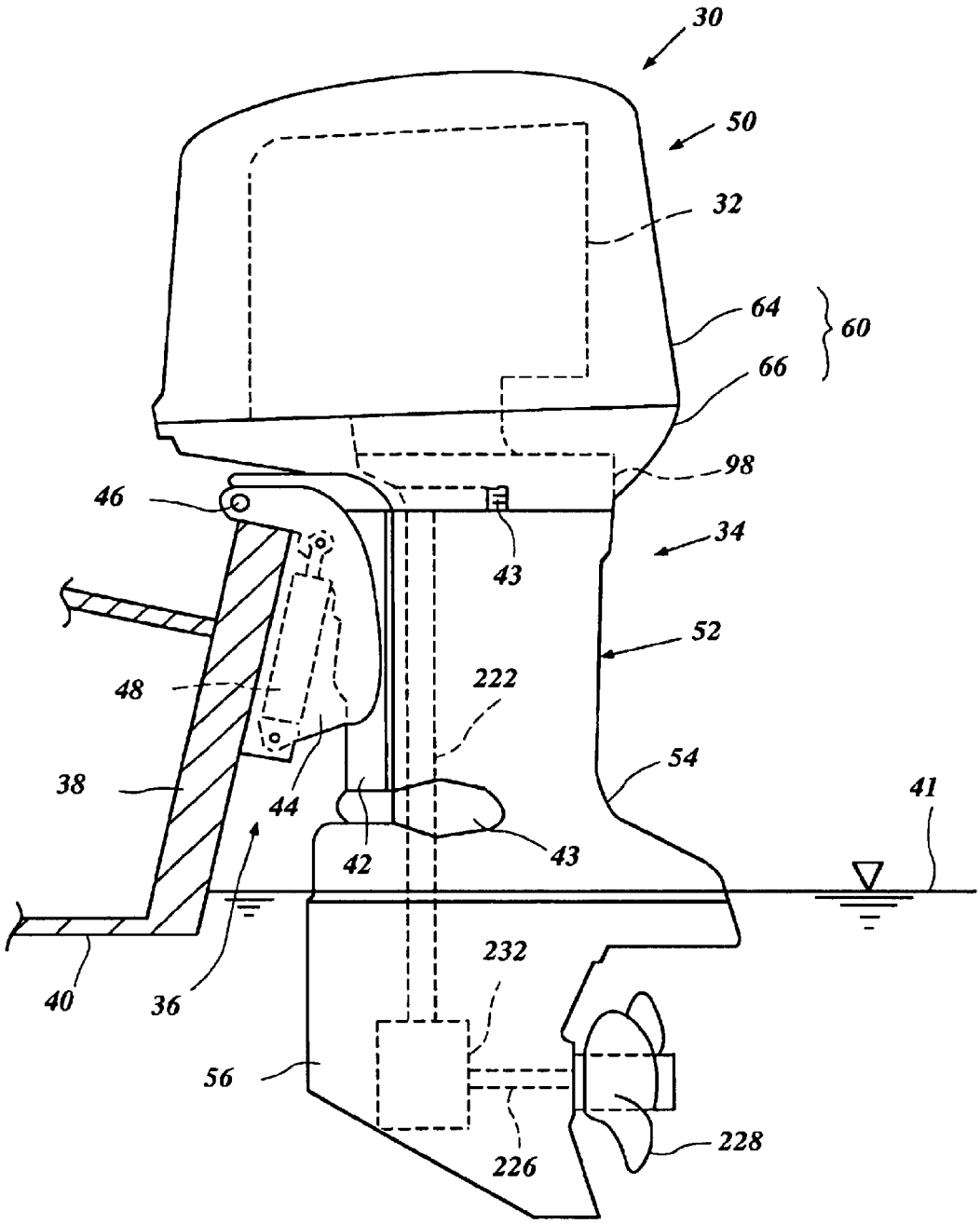
FIG. 1 is a side elevational view of an outboard motor having an engine configured in accordance with a preferred embodiment of the present invention.

With reference to FIGS. 1-7, an overall construction of an outboard motor 30 that employs an internal combustion engine 32 configured in accordance with certain features, aspects and advantages of the present invention will be described. The engine has particular utility in the context of a marine drive such as an outboard motor, and thus is described in the context of an outboard motor. The engine, however, can be used with other types of marine drives and also land vehicles, and further can be used as a stationary engine.

In the illustrated arrangement, the outboard motor 30 comprises a drive unit 34 and a bracket assembly 36. The bracket assembly 36 supports the drive unit 34 on a transom 38 of an associated watercraft 40 and places a marine propulsion device in a submerged position when the watercraft 40 is resting on the surface 41 of a body of water. The bracket assembly 36 preferably comprises a swivel bracket 42, a clamping bracket 44, a steering shaft and a pivot pin 46.

The steering shaft typically extends through the swivel bracket 42 and is affixed to the drive unit 34 by top and bottom mount assemblies 43. The steering shaft is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 46 completes a hinge coupling between the swivel bracket 42 and the clamping bracket 44. The pivot pin 46 extends through the bracket arms so that the clamping bracket 44 supports the swivel bracket 42 for pivotal movement about a generally horizontally extending tilt axis defined by the pivot pin 46. The drive unit 34 thus can be tilted or trimmed about the pivot pin 46.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system 48 preferably is provided between the swivel bracket 42 and the clamping bracket 44 for tilt movement (raising or lowering) of the swivel bracket 42 and the drive unit 34 relative to the clamping bracket 44. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 50 and a housing unit 52 which includes a driveshaft housing 54 and a lower unit 56. The power head 50 is disposed atop the drive unit 34 and includes an internal combustion engine 32 that is positioned within a protective cowling 60 that preferably is made of plastic. Preferably, the protective cowling 60 defines a generally enclosed cavity 62 in which the engine 32 is disposed. The protective cowling assembly 60 preferably comprises a top cowling member 64 and a bottom cowling member 66. The top cowling member 64 preferably is detachably affixed to the bottom cowling member 66 by a coupling mechanism so that a user, operator, mechanic or repair person can access the engine 32 for maintenance or for other purposes.

Figure 5:
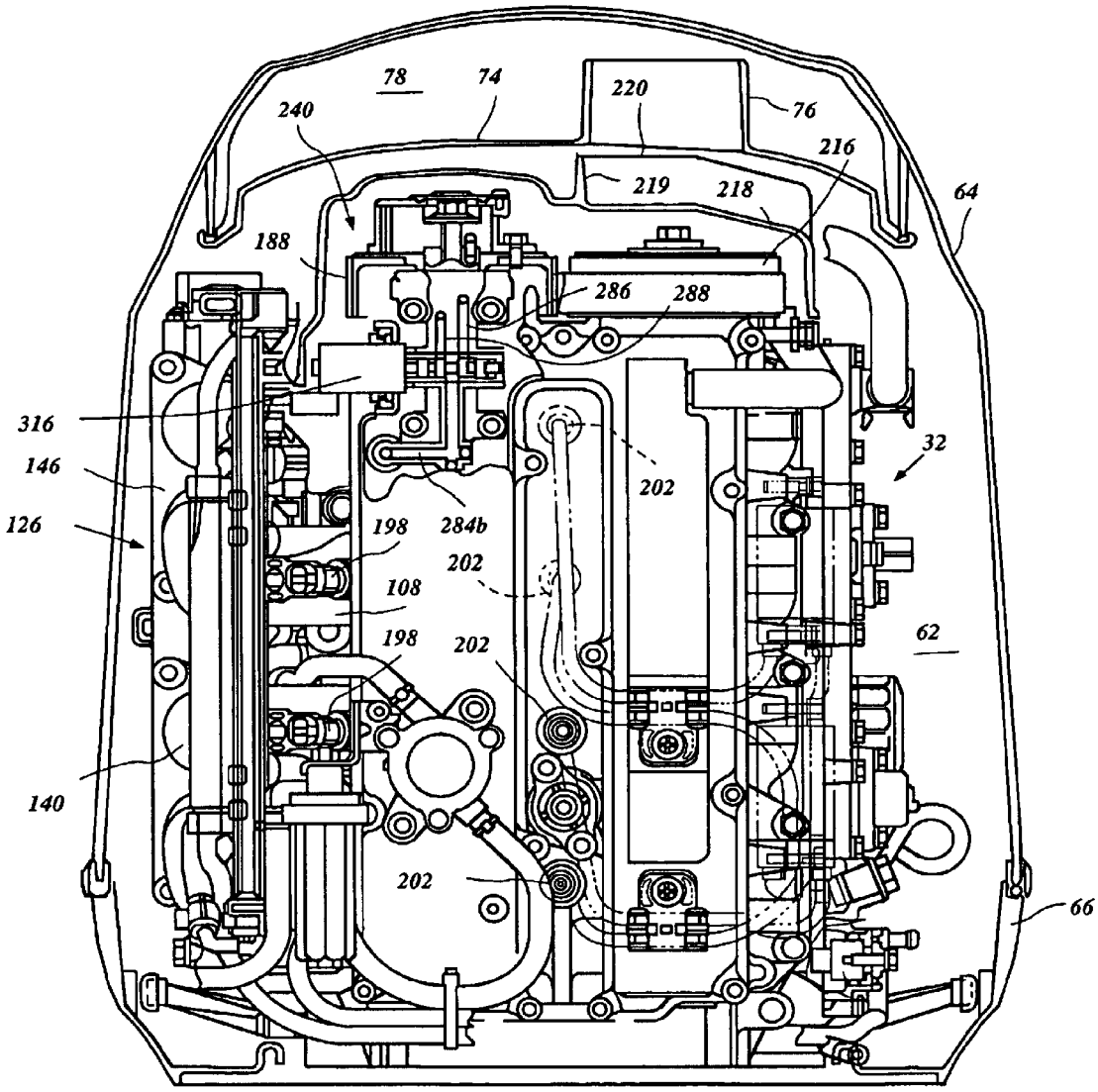
FIG. 5 is a rear view of the power head. The cowling assembly is shown in section taken along the line 5-5 of FIG. 2.

The top cowling member 64 preferably has a rear intake opening 72 on its rear and top portion. A rear intake member 74 with a rear air duct 76 is affixed to the top cowling member 64. A rear air intake space 78 is defined between the rear intake member 74 and the rear top portion of the top cowling member 64. As seen in FIG. 5, the rear air duct 74 is disposed toward the starboard side of the rear intake member 74.

Figure 2:
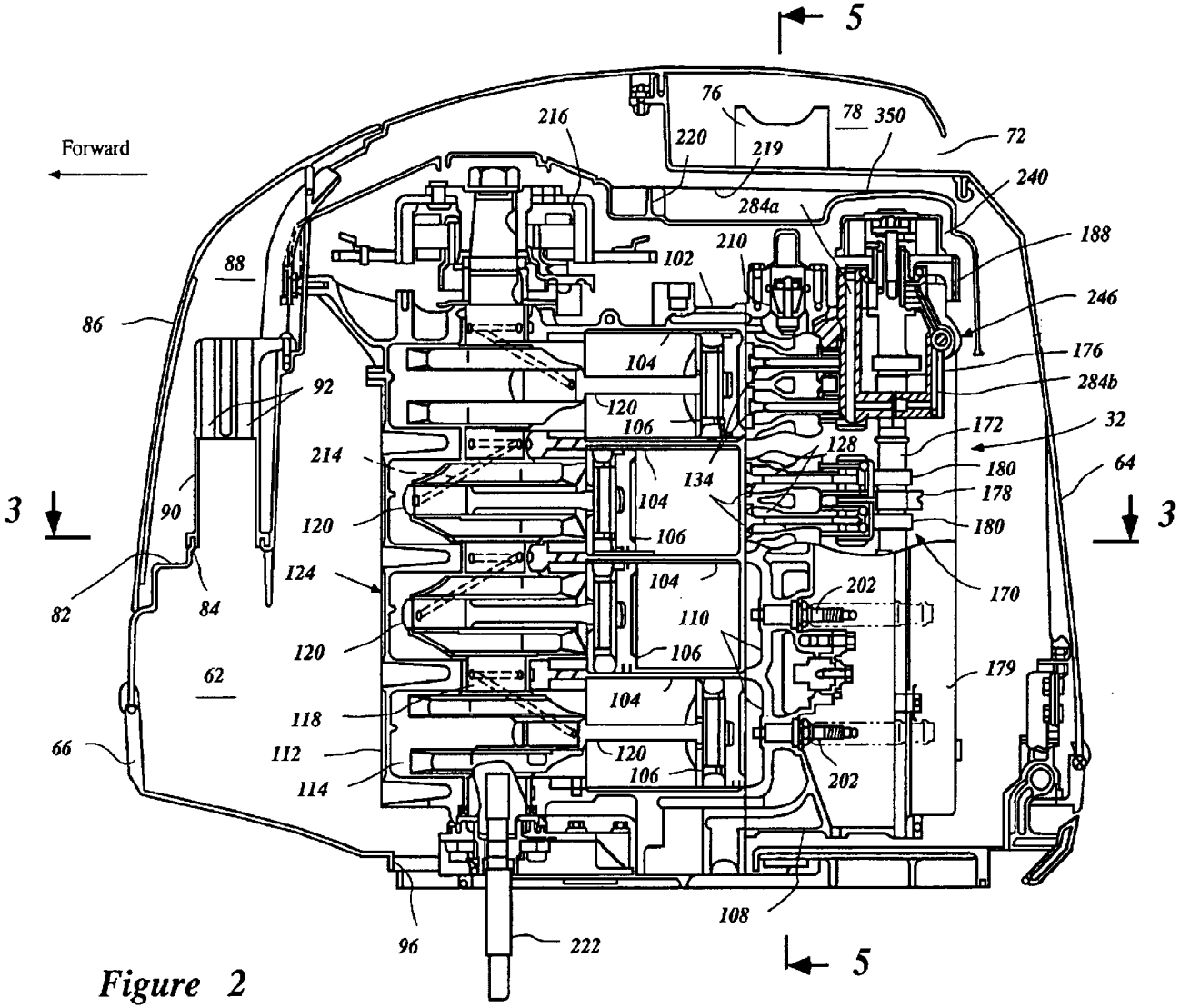
FIG. 2 is a sectional side view of a power head of the outboard motor. The side view is on the port side. An engine of the power head is also shown in section. A camshaft drive mechanism is omitted in this figure except for an intake driven sprocket.
Figure 3:
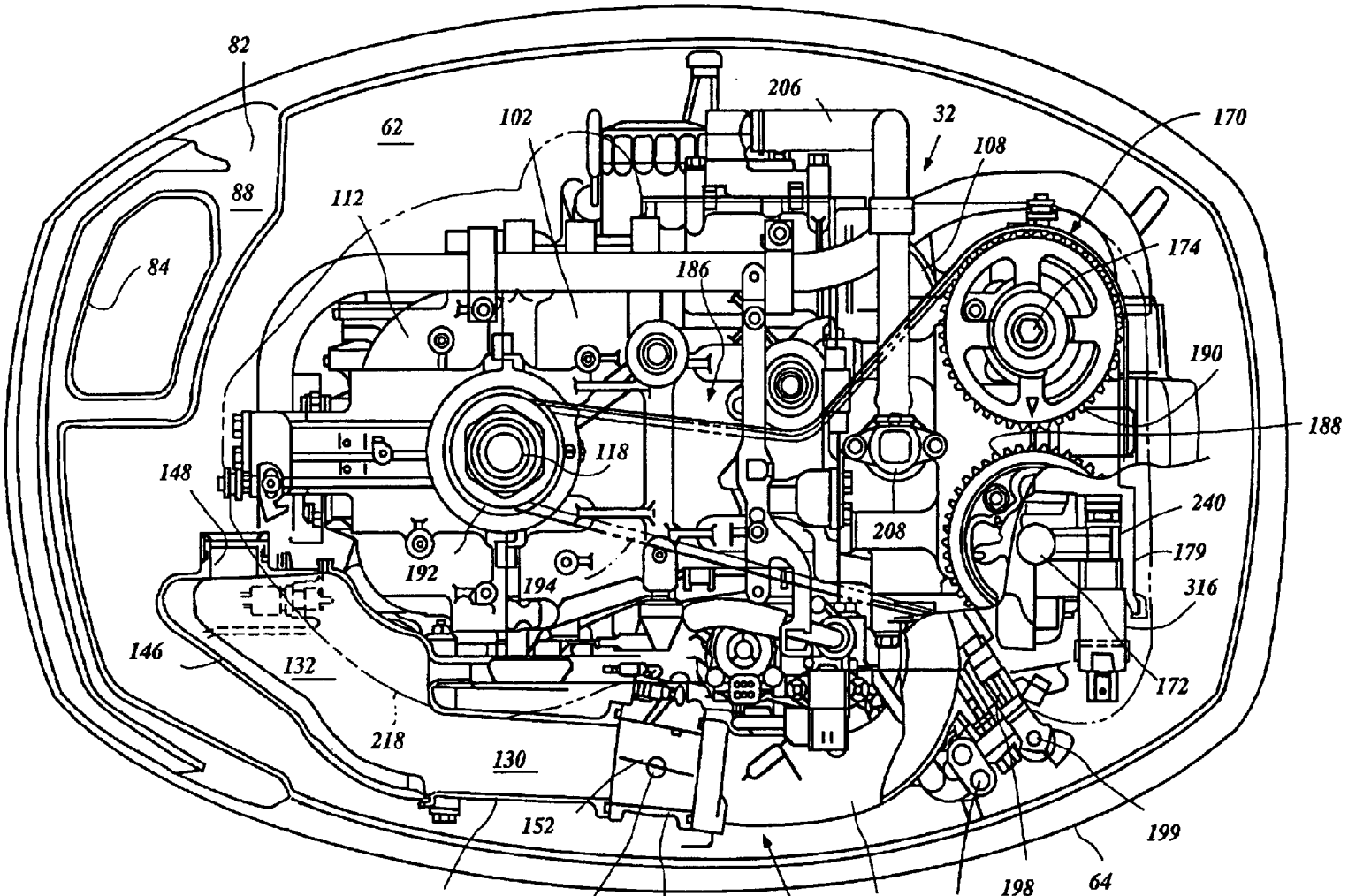
FIG. 3 is a top plan view of the power head. A cowling assembly is shown in section taken along the line 3-3 of FIG. 2. A protective cover is shown in phantom line.
Figure 4:
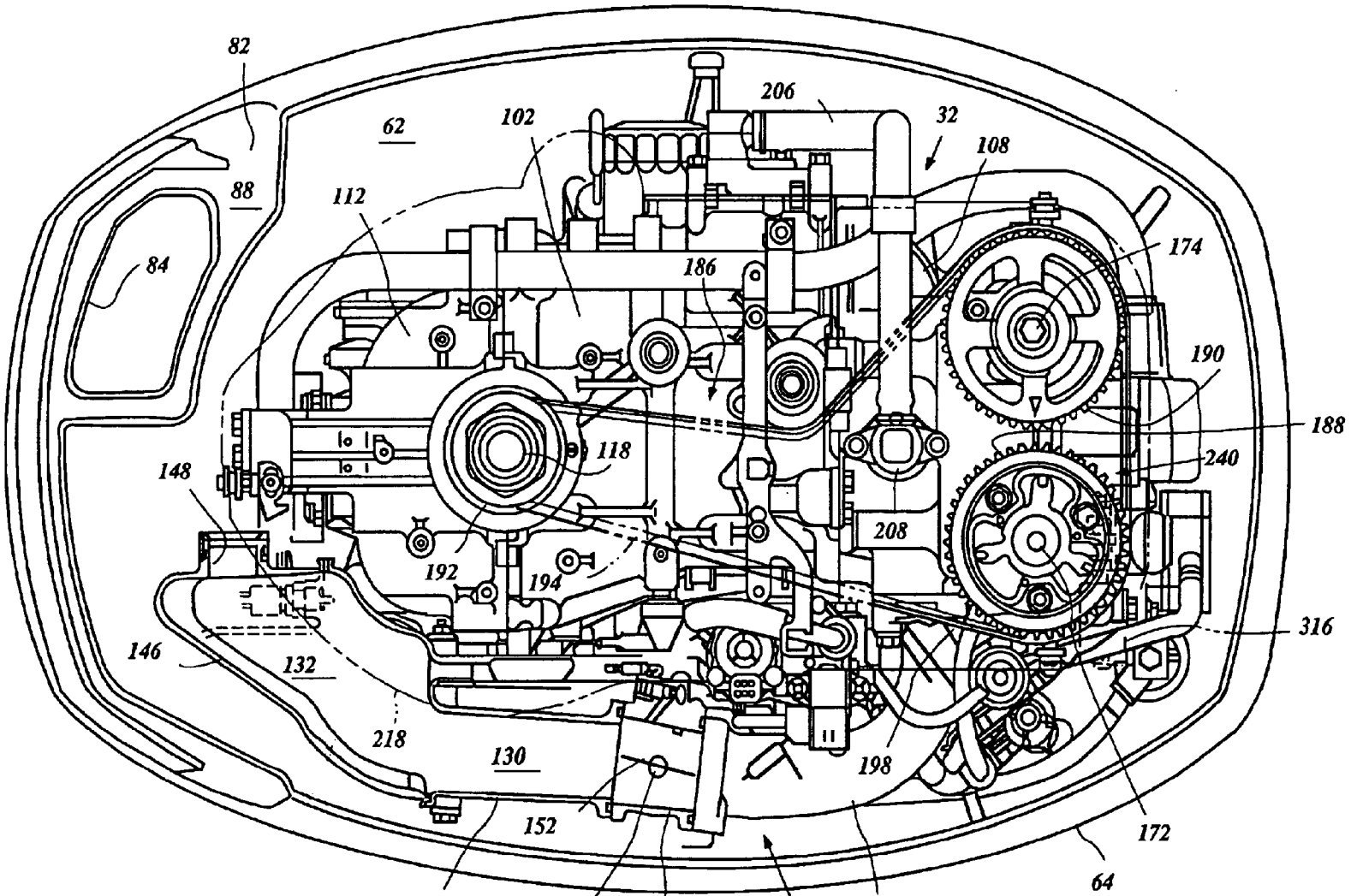
FIG. 4 is almost the same top plan view of the power head as that shown in FIG. 3.

With more specific reference to FIGS. 2-4, a recessed portion 82 is formed at a front end of the top cowling member 64. An opening 84 is defined at the recessed portion 82 and on the starboard side. An outer shell 86 covers the recessed portion 82 to define a front air intake space 88. A front air duct 90 is affixed to the recessed portion 82 of the top cowling member 64 to be placed over the opening 84 and to communicate with the enclosed cavity 62. The air duct 90 has a plurality of apertures 92, each of which is circularly configured in section. A front intake opening is defined between the recessed portion 82 of the top cowling member 64 and the outer shell 86 so that the front intake space 88 communicates with the environment outside of the cowling assembly 60. Ambient air thus is drawn through the rear intake opening 72 or the front intake opening, further through the air ducts 76, 90 and into the enclosed cavity 62.

Typically, the top cowling member 64 tapers in girth toward its top surface, which is in the general proximity of the air intake opening 72.

The bottom cowling member 66 preferably has an opening 96 at its bottom portion through which an upper portion of an exhaust guide member 98 (FIG. 1) extends. The exhaust guide member 98 preferably is made of aluminum alloy and is affixed atop the driveshaft housing 54. The bottom cowling member 66 and the exhaust guide member 98 together generally form a tray. The engine 32 is placed onto this tray and is affixed to the exhaust guide member 98. The exhaust guide member 98 also has an exhaust passage through which burnt charges (e.g., exhaust gases) from the engine 32 are discharged.

The engine 32 in the illustrated embodiment operates on a four-cycle combustion principle. The engine 32 has a cylinder block 102. The presently preferred cylinder block 102 defines four cylinder bores 104 which extend generally horizontally and are generally vertically spaced from one another. As used in this description, the term "horizontally" means that the subject portions, members or components extend generally parallel to the water line 41 when the drive unit 34 is not tilted and is placed in the position shown in FIG. 1. The term "vertically" in turn means that portions, members or components extend generally normal to those that extend horizontally.

The illustrated engine merely exemplifies one type of engine on which various aspects and features of the present invention can be suitably used. Engines having other number of cylinders, having other cylinder arrangements, and operating on other combustion principles (e.g., rotary) also can employ various features, aspects and advantages of the present invention.

Continuing with reference to FIGS. 1-7, and with specific reference to FIG. 2, a piston 106 reciprocates in each cylinder bore 104 in a well-known manner. A cylinder head assembly 108 is affixed to one end of the cylinder block 102 for closing the cylinder bores 104. The cylinder head assembly 108 preferably defines four combustion chambers 110 together with the associated pistons 106 and cylinder bores 104. Of course, the number of combustion chambers can vary, as indicated above. A crankcase member 112 closes the other end of the cylinder bores 104 to define a crankcase chamber 114 together with the cylinder block 102. A crankshaft or output shaft 118 extends generally vertically through the crankcase chamber 114 and is journaled for rotation by several bearing blocks in a suitable arrangement. Connecting rods 120 couple the crankshaft 118 with the respective pistons 106 in a well-known manner. Thus, the crankshaft 118 can rotate with the reciprocal movement of the pistons 106.

Preferably, the crankcase member 112 is located at the most forward position, with the cylinder block 102 and the cylinder head member 108 extending rearward from the crankcase member 112, one after the other. Generally, the cylinder block 102, the cylinder head member 108 and the crankcase member 112 together define an engine body 124. Preferably, at least these major engine portions 102, 108, 112 are made of aluminum alloy. The aluminum alloy advantageously increases strength over cast iron while decreasing the weight of the engine body 96.

The engine 32 comprises an air induction system or device 126. The air induction system 126 draws air from the cavity 62 into the combustion chambers 110. The air induction system 126 preferably comprises eight intake ports 128 (FIGS. 2 and 6), four intake passages 130 and a single plenum chamber 132. In the plenum chamber 132 intake passages 130 and intake ports 128 are each oriented toward the left side of the engine.

Two intake ports 128 are allotted to one combustion chamber 110 and also to one intake passage 130. The intake ports 128 are defined in the cylinder head assembly 108. Intake valves 134 are slidably disposed at the cylinder head member 108 to move between an open position and a closed position of the intake ports 128. Normally, bias springs 136 (FIG. 7) urge the intake valves 134 toward the respective closed positions by retainers 138 that are affixed to the valves 134. When each intake valve 134 is in the open position, the intake passage 130 that is associated with the intake port 128 communicates with the associated combustion chamber 110.

As seen in FIGS. 3 and 4, each intake passage 130 preferably is defined with an intake manifold 140, a throttle body 142 and an intake runner 144. The intake manifold 140 and the throttle body 142 preferably are made of aluminum alloy, while the intake runner 144 is made of plastic. A portion of the intake runner 144 extends forwardly. The respective portions of the intake runners 144 define the plenum chamber 132 together with a plenum chamber member 146 that preferably is made of plastic.

The plenum chamber 132 has an air inlet 148 that opens into the cavity toward a front of the cavity 62. The air in the closed cavity 62 is drawn into the plenum chamber 132 through the air inlet 148 and is coordinated therein before flowing through the respective intake passages 130. The plenum chamber 132 acts also as an intake silencer.

Figure 6:
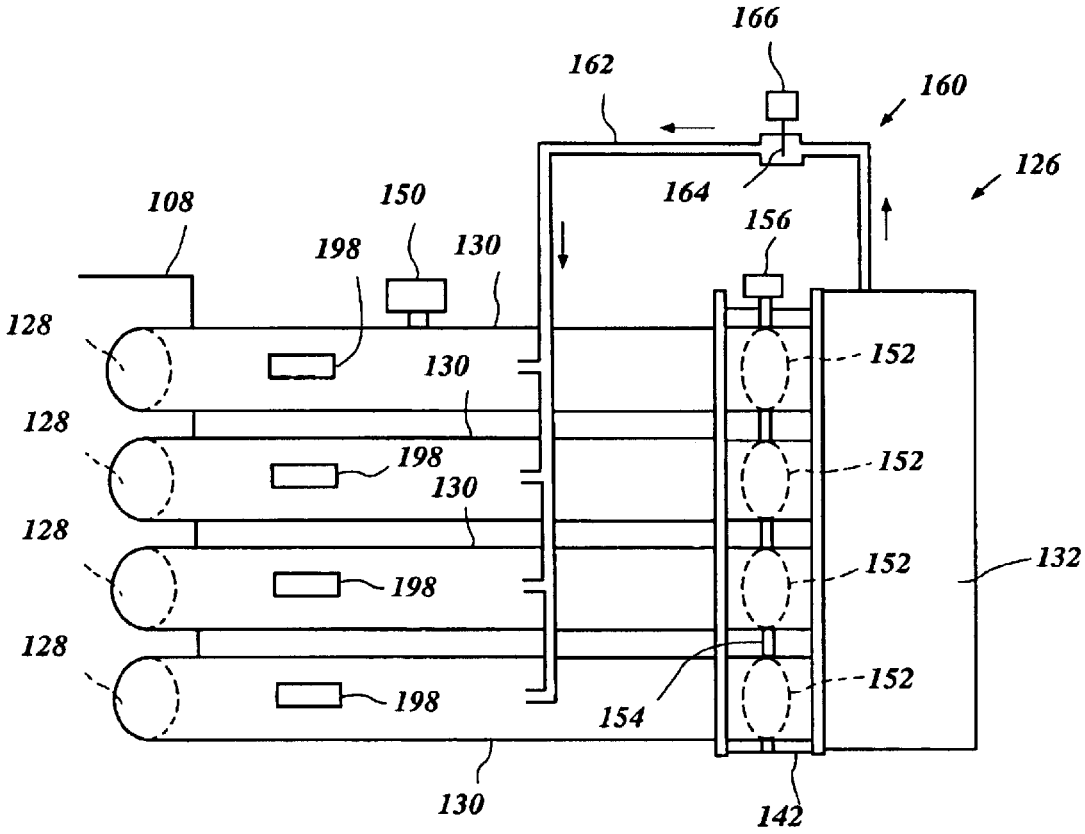
FIG. 6 is a schematic view of an air intake system employed for the engine.

In the illustrated embodiment, as seen in FIG. 6, the intake passage 130, i.e., the intake manifold 140 or the intake runner 144, that lies atop of four passages 130 has an intake pressure sensor 150 to sense a pressure in the associated intake passage 130. Because the respective intake passages 130 are each substantially the same size, and the plenum chamber 132 coordinates the air before delivering it to the intake passages 130, every passage 130 has substantially equal pressure and a signal of the pressure sensor 150 thus can represent a condition of the respective pressure.

Each throttle body 142 has a throttle valve 152 journaled for pivotal movement about an axis of a valve shaft 154 that extends generally vertically. The valve shaft 154 links the entire valves 152 to move them simultaneously. The valve shaft 154 is operable by the operator through an appropriate conventional throttle valve linkage. The throttle valves 152 are movable between an open position and a closed position to measure or regulate an amount of air flowing through the respective air intake passages 130. Normally, the greater the opening degree, the higher the rate of airflow and the higher the engine speed.

In order to bring the engine 32 to idle speed and to retain idle speed, the throttle valves 152 are almost closed but preferably not completely closed to ensure a stable idle speed and to prevent adhesion of the throttle valves 152. As used through the description, the term "idle speed" means an engine speed that is when the throttle valves 152 are closed but includes a state such that the valves 152 are slightly open to allow a quite small amount of air to flow. A throttle position sensor 156 (FIG. 6) preferably is disposed atop the valve shaft 154 to sense a position between the open and closed positions of the throttle valves 152.

As seen in FIG. 6, the air induction system 126 preferably includes an idle air delivery device or idle speed control (ISC) mechanism 160 that bypasses the throttle valves 152 and extends from the plenum chamber 132 to the respective intake passages 130. Idle air thus is delivered to the combustion chambers 110 through the idle air delivery device 160 and the rest of the intake passages 130 when the throttle valves 152 are substantially placed in the closed position. The idle air delivery device 160 preferably comprises an idle air passage 162, an idle valve 164 and an idle valve actuator 166. The idle air passage 162 is branched off to the respective intake passages 130. The idle valve 164 preferably is a needle valve that can move between an open position and a closed position of the idle passage 162. The idle valve actuator 166 actuates the idle valve 164 to a certain position to measure or adjust an amount of the idle air.

The engine 32 also includes an exhaust system that routes burnt charges, i.e., exhaust gases, to a location outside of the outboard motor 30. Each cylinder bore 104 preferably has two exhaust ports defined in the cylinder head member 108. The exhaust ports are selectively opened and closed by exhaust valves. A structure of each exhaust valve and an arrangement of the exhaust valves substantially are the same as the intake valve and the arrangement thereof, respectively. An exhaust manifold preferably is formed next to the exhaust ports and extends generally vertically. The exhaust manifold communicates with the combustion chambers 110 through the exhaust ports to collect exhaust gases therefrom. The exhaust manifold is coupled with the foregoing exhaust passage of the exhaust guide member 98. When the exhaust ports are opened, the combustion chambers 110 thus communicate with the exhaust passage through the exhaust manifold.

Figure 7:
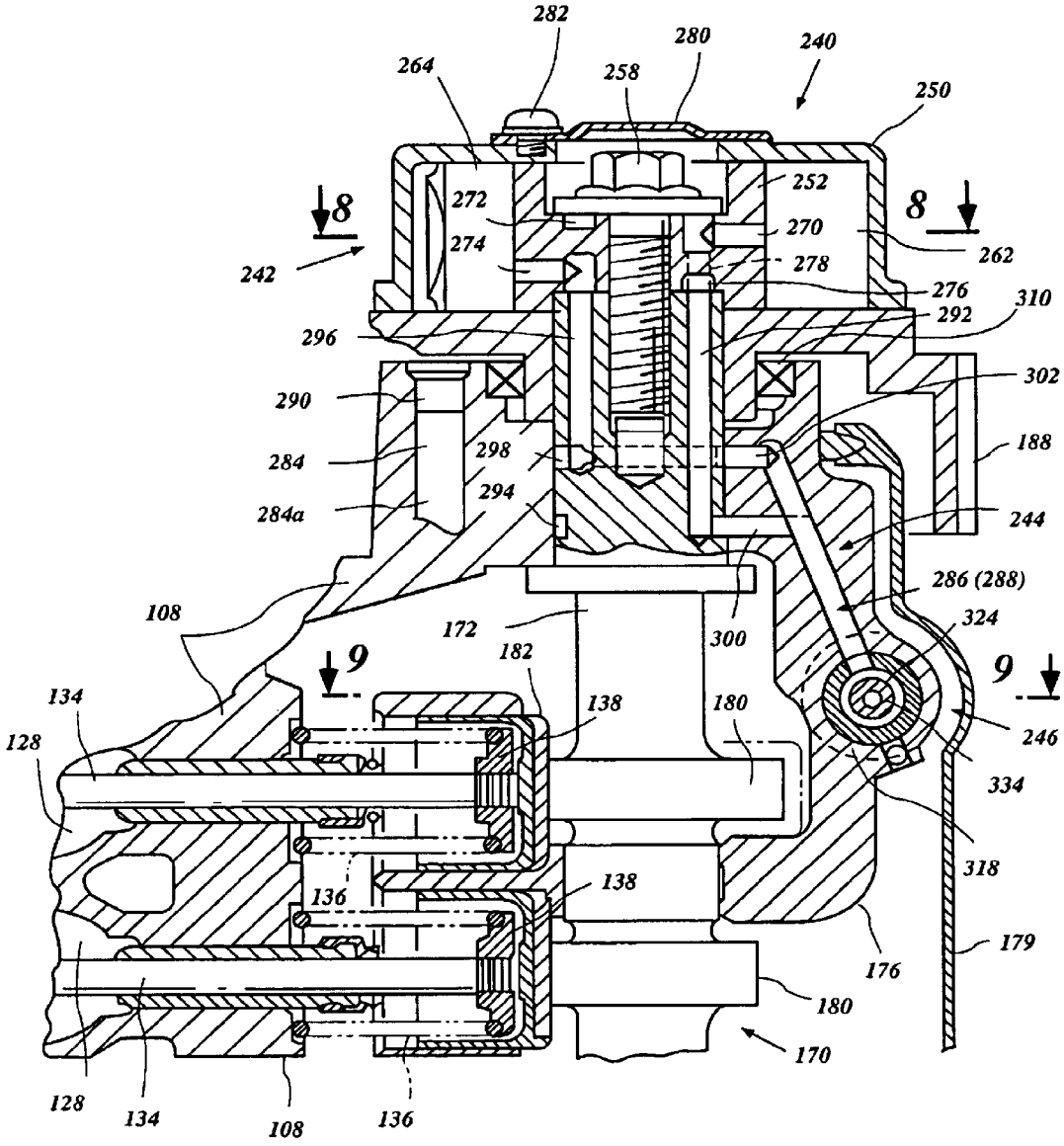
FIG. 7 is an enlarged, sectional side view of the engine showing a variable valve timing (VVT) mechanism.

A valve cam mechanism or valve actuator 170 preferably is provided for actuating the intake valves 134 and the exhaust valves. In the illustrated embodiment, the valve cam mechanism 170 includes an intake camshaft 172 and an exhaust camshaft 174 both extending generally vertically and journaled for rotation by the cylinder head member 108 and bearing caps 176, 178 (FIG. 2). A camshaft cover 179 is affixed to the cylinder head member 108 to cover the camshafts 172, 174. Each camshaft 172, 174, as best seen in FIG. 7, has cam lobes 180 to push valve lifters 182 that are affixed to the respective ends of the intake valves 134 and exhaust valves as in a known manner. The cam lobes 180 repeatedly push the valve lifters 182 at timing in proportion to the engine speed with the rotation of the camshafts 172, 174 to actuate the intake valves 134 and the exhaust valves.

A camshaft drive mechanism 186 (FIGS. 3 and 4) is provided for driving the valve cam mechanism 170. As best seen in FIG. 3, while the intake camshaft 172 and the exhaust camshaft 174 have an intake driven sprocket 188 positioned atop the intake camshaft 172 and an exhaust driven sprocket 190 positioned atop the exhaust camshaft 174, respectively, the crankshaft 118 has a drive sprocket 192 positioned almost atop thereof. A timing chain or belt 194 is wound around the driven sprockets 188, 190 and the drive sprocket 192. The crankshaft 118 thus drives the respective camshafts 172, 174 through the timing chain 194 in the timed relationship. Because the camshafts 172, 174 must rotate at half of the speed of the rotation of the crankshaft 118 in the four-cycle combustion principle, a diameter of the driven sprockets 188, 190 is twice as large as a diameter of the drive sprocket 192.

The engine 32 preferably has a port or manifold fuel injection system. The fuel injection system preferably comprises four fuel injectors 198, with one fuel injector allotted for each of the respective combustion chambers 110 through suitable fuel conduits 199. The fuel injectors 198 are mounted on a fuel rail 200 which is mounted on the cylinder head member 108. The fuel rail 199 also defines a portion of the fuel conduits 199. Each fuel injector 198 preferably has an injection nozzle directed toward the associated intake passage 130 adjacent to the intake ports 134. The fuel injectors 198 spray fuel into the intake passages 130 under control of an electronic control unit (ECU) that is mounted on the engine body 124 at an appropriate location. The ECU controls initiate timing and duration of fuel injection so that the fuel injector nozzles spray a proper amount of the fuel per combustion cycle. Of course, the fuel injectors 198 can be disposed for direct cylinder injection, carburetors can replace or accompany the fuel injectors 198.

The engine 32 further comprises an ignition or firing system. Each combustion chamber 110 is provided with a spark plug 202 that is connected to the ECU through an igniter so that ignition timing is also controlled by the ECU. Each spark plug 202 has electrodes that are exposed into the associated combustion chamber and are spaced apart from each other with a small gap. The spark plugs 202, with the structure, make a spark between the electrodes to ignite an air/fuel charge in the combustion chamber 110 at selected ignition timing under control of the ECU.

In the illustrated engine 32, the pistons 106 reciprocate between top dead center and bottom dead center. When the crankshaft 118 makes two rotations, the pistons 106 generally move from top dead center to bottom dead center (the intake stroke), from bottom dead center to top dead center (the compression stroke), from top dead center to bottom dead center (the power stroke) and from bottom dead center to top dead center (the exhaust stroke). During the four strokes of the pistons 106, the camshafts 172, 174 make one rotation and actuate the intake valves 134 and the exhaust valves so that the intake ports 128 are opened during the intake stroke and the exhaust ports are opened during the exhaust stroke.

Generally, during the intake stroke, air is drawn into the combustion chambers 110 through the air intake passages 130 and fuel is injected into the intake passages 130 by the fuel injectors 198. The air and the fuel thus are mixed to form the air/fuel charge in the combustion chambers 110. Slightly before or during the power stroke, the respective spark plugs 202 ignite the compressed air/fuel charge in the respective combustion chambers 110. The air/fuel charge thus furiously burns during the power stroke to reciprocate the pistons 106. The burnt charges, i.e., exhaust gases, then are discharged from the combustion chambers 110 during the exhaust stroke.

During engine operation, heat builds in the engine body 124. The engine 32 thus includes a cooling system to cool the engine body 124. The outboard motor 30 preferably employs an open-loop type water cooling system that introduces cooling water from the body of water surrounding the motor 30 and then discharges the water back to the water body. The cooling system includes one or more water jackets defined within the engine body 124 through which the introduced water runs to remove heat from the engine body 124. A water discharge pipe 206 (FIGS. 3 and 4) conveys discharge water from the water jackets away from the engine body 124. A thermostat chamber 208 is defined at a location where the discharge pipe 206 is connected to the engine body 124 and encloses a thermostat 210 (FIG. 2) that controls flow of the discharge water. When the water temperature is relatively low immediately after the engine 32 is started, the thermostat 210 closes so as to inhibit the water from flowing out of the engine. Thus, the flow of cooling water is temporarily stopped immediately after engine startup so that the engine 32 can be warmed up quickly A temperature at which the thermostat opens preferably is set as about 50-60° C.

The engine 32 preferably includes a lubrication system. Although many types of lubrication systems can be applied, a closed-loop type system is employed in the illustrated embodiment. The lubrication system comprises a lubricant tank defining a reservoir cavity preferably positioned within the driveshaft housing 54. An oil pump is provided at a desired location, such as atop the driveshaft housing 54, to pressurize the lubricant oil in the reservoir cavity and to pass the lubricant oil through a suction pipe toward engine portions, which are lubricated, through lubricant delivery passages. The engine portions that need lubrication include, for example, the crankshaft bearings, the connecting rods 120 and the pistons 106. For example, portions 214 of the delivery passages (FIG. 2) are defined in the crankshaft 118.

Lubricant return passages also are provided to return the oil to the lubricant tank for re-circulation.

A flywheel assembly 216 preferably is positioned atop the crankshaft 118 and is mounted for rotation with the crankshaft 118. The flywheel assembly 216 comprises a flywheel magneto or AC generator that supplies electric power to various electrical components such as the fuel injection system, the ignition system and the ECU.

A protective cover 218, which preferably is made of plastic, extends over the major top portion of the engine 32 to cover the portion including the flywheel assembly 216 and the camshaft drive mechanism 186. As seen in FIG. 2, a bottom portion, at least in part, of the protective cover 218 is left open. Radiation of heat from the engine thus is enabled.

The protective cover 218 preferably has a transverse rib 220 (FIGS. 2 and 5) that extends upwardly from the cover 218 and inhibits air that has entered the enclosed space 62 through the air duct 76 from flowing directly over the cover toward the front of the engine. As shown in FIG. 2, the rib 220 is positioned forwardly of the air duct 76. A longitudinal rib 219 (FIGS. 2 and 5) also extends upwardly from the cover and inhibits air from the air duct 76 from flowing directly toward the port side of the engine, where the air induction system 126 is located. As shown in FIG. 5, rib 219 preferably is positioned toward the port side relative to the air duct 76.

The ribs 219, 220 are preferably substantially perpendicular to each other, with rib 219 being elongate and generally positioned to run in a fore/aft direction and rib 220 being generally normal to rib 219. The ribs 219, 220 advantageously help airflow move around the engine body 124 to cool the engine body 124. More specifically, much of the intake air from the air duct 76 is directed to the starboard (exhaust) side of the engine 32, and flows over the engine toward the plenum chamber air inlet 148, which is located toward the front and port sides of the engine 32.

The ribs 219, 220 also help define a tortuous airflow path that helps remove water that may be entrained in intake air. The removed water collects on the cover 218 and is directed by the ribs 219, 220 toward the starboard (exhaust) side of the motor, and away from engine components that may be particularly sensitive to water contact. Thus, the rib arrangement helps protect certain engine components from intrusion of water thereon.

The driveshaft housing 54 depends from the power head 50 to support a driveshaft 222 which is coupled with the crankshaft 118 and extends generally vertically through the driveshaft housing 54. The driveshaft 222 is journaled for rotation and is driven by the crankshaft 118. The driveshaft housing 54 preferably defines an internal section of the exhaust system that directs the majority of exhaust gases to the lower unit 56. An idle discharge section is branched off from the internal section so that when the engine 13 is at idle speed, idle exhaust gases are discharged directly to the atmosphere through a discharge port that is formed on a rear surface of the driveshaft housing 54. The driveshaft 222 preferably drives the oil pump.

The lower unit 56 depends from the driveshaft housing 54 and supports a propulsion shaft 226 (FIG. 1) that is driven by the driveshaft 222. The propulsion shaft 226 extends generally horizontally through the lower unit 56 and is journaled for rotation. A propulsion device is attached to the propulsion shaft 226. In the illustrated arrangement, the propulsion device is a propeller 228 that is affixed to an outer end of the propulsion shaft 226. The propulsion device, however, can take the form of a dual counter-rotating system, a hydrodynamic jet, or any of a number of other suitable propulsion devices.

A transmission 232 preferably is provided between the driveshaft 222 and the propulsion shaft 226, which lie generally normal to each other (i.e., at a 90° shaft angle), to couple together the two shafts 222, 226 through bevel gears. The outboard motor 30 has a clutch mechanism that allows the transmission 146 to change the rotational direction of the propeller 144 among forward, neutral or reverse.

The lower unit 56 also defines an internal section of the exhaust system that is contiguously connected with the internal section of the driveshaft housing 54. At engine speeds above idle, the exhaust gases generally are discharged to the body of water surrounding the outboard motor 30 through the internal sections and then a discharge section defined within the hub of the propeller 228. Incidentally, the exhaust system can include a catalytic device at any location in the exhaust system to purify the exhaust gases.

With continued reference to FIGS. 2-5 and 7, and additionally with reference to FIGS. 8 and 9, the variable valve timing (VVT) mechanism or setting mechanism 240 will now be described below.

The VVT mechanism 240 preferably is configured to set the intake camshaft 172 to an angular position that is between a first angular position and a second angular position with respect to the intake driven sprocket 188. At the first angular position, the intake camshaft 172 opens and closes the intake valves 134 at the most advanced timing. At the second angular position, the intake camshaft 172 opens and closes the intake valves 134 at the most delayed timing. Any angular position between both the first and second angular position is delayed with respect to the first angular position and is advanced with respect to the second angular position.

The VVT mechanism 240 preferably is hydraulically operated. As best seen in FIG. 7, the illustrated VVT mechanism 240 comprises a setting section 242, a fluid supply section 244 and a control section 246. As will be explained in more detail below, the setting section 242 sets the intake camshaft 172 at a certain angular position with respect to the intake driven sprocket 188 in response to a rate of working fluid flow that is allotted to each of two spaces of the setting section 242. The fluid supply section 244 preferably supplies the working fluid to the setting section 242. Preferably, the working fluid is a portion of the lubricant from the lubrication system. Of course in some arrangements, a separate hydraulic circuit can be formed. The control section 246 selects the amount of the working fluid allotted to each of the two spaces and preferably is under the control of the ECU.

Figure 8:
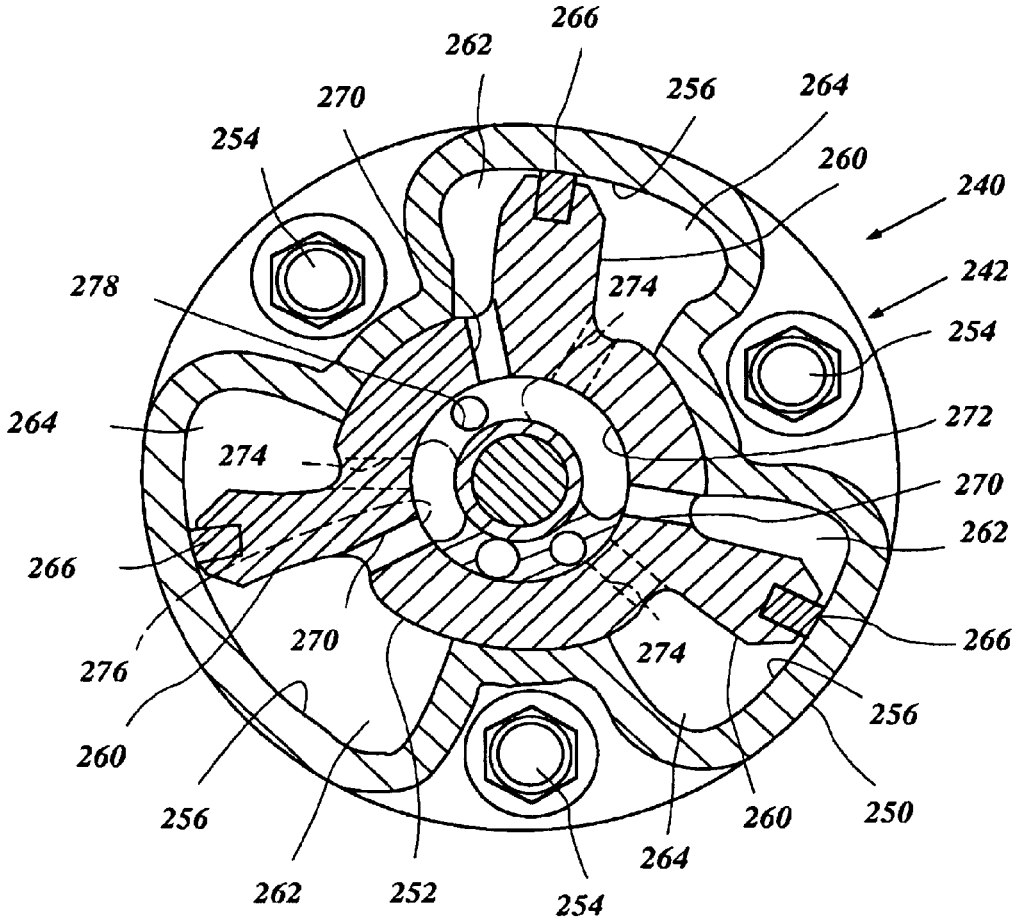
FIG. 8 is a sectional view of the VVT mechanism taken along the line 8-8 of FIG. 7.

With particular reference to FIGS. 7 and 8, the setting mechanism 242 preferably includes an outer housing 250 and an inner rotor 252. The illustrated outer housing 250 is affixed to the intake driven sprocket 188 by three bolts 254 and preferably forms at least one chamber 256 and more preferably three chambers 256, which can be positioned between the three bolts 254. The inner rotor 252 is affixed atop of the intake camshaft 172 by a bolt 258 and preferably has at least one vane 260 pivotably placed within each of the respective chambers 256 of the housing 250. In the illustrated arrangement, the inner rotor 252 has three vanes 260 that extend radially and are spaced apart from each other by angle of approximately 120 degrees. The sides of each vane 260 divide the respective chambers 256 such that define a first space 262 and a second space 264. Seal members 266 preferably are carried by the respective vanes 260 and abut on an inner surface of the housing 250 so as to substantially separate the first and second spaces 262, 264 from each other.

The respective first spaces 262 communicate with one another through respective pathways 270 and a ditch 272 that is formed around the bolt 258, while the respective second spaces 264 communicate with one another through respective pathways 274 and a ditch 276 that is also formed around the bolt 258. The ditches 272, 276 in the illustrated arrangement generally are configured as a substantially circular flow path around the bolt and are axially offset from one another. A pathway 278 extends from the ditch 272 to a bottom portion of the rotor 252. A cover member 280 is affixed to the outer housing 250 by screws 282 to cover the bolt 258.

Figure 9:
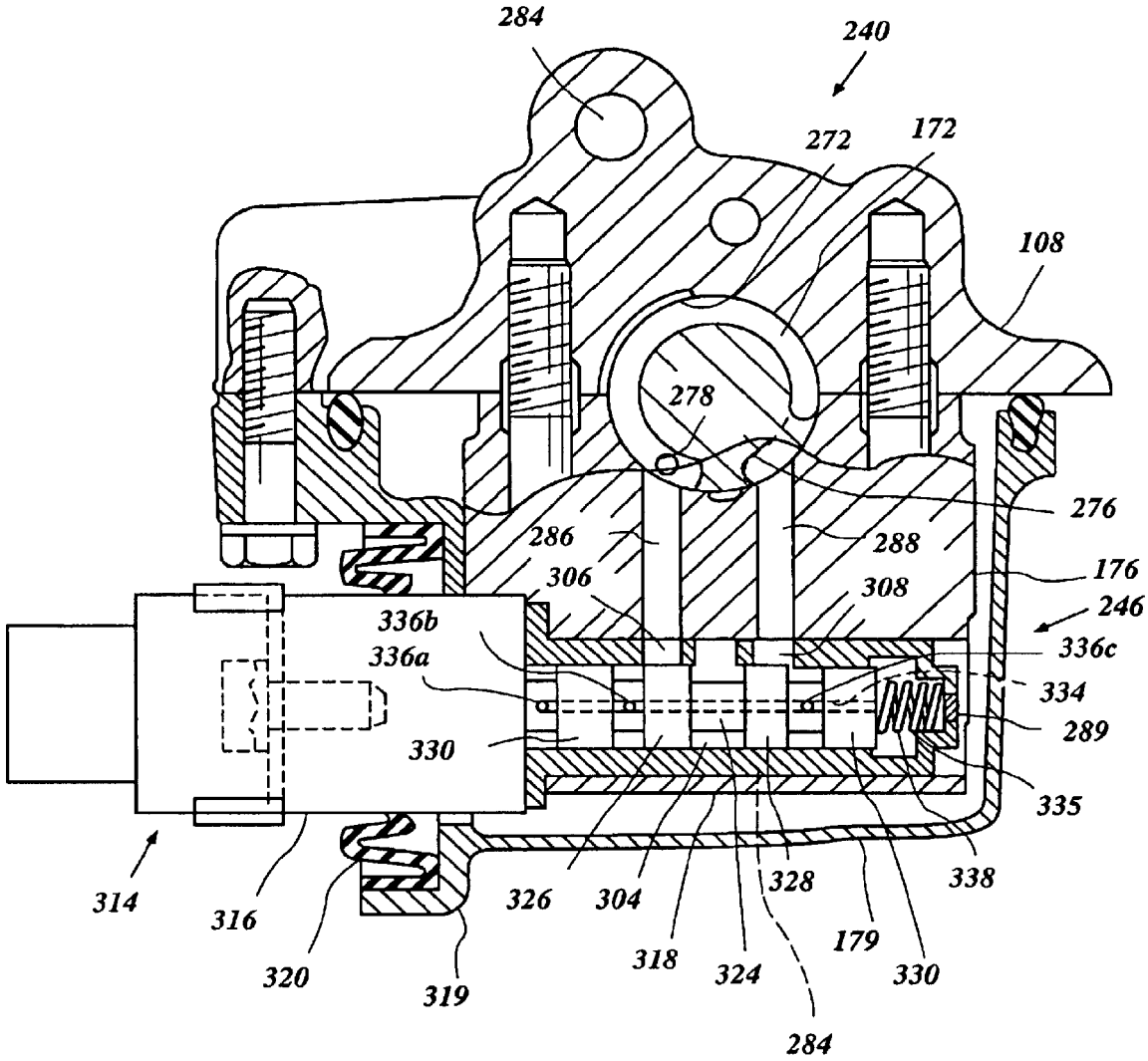
FIG. 9 is a sectional view of the VVT mechanism taken along the line 9-9 of FIG. 7.

With particular reference to FIGS. 7 and 9, the fluid supply section 244 preferably includes a supply passage 284 (see also FIG. 2) and a first and second passages 286, 288. The supply passage 284 and the first and second passages 286, 288 communicate with one another through the control section 246. The supply passage 284 preferably has a passage portion 284*a* (FIG. 5) defined in the cylinder head assembly 108 and a passage portion 284*b* (FIG. 2) defined in the bearing cap 176.

In some embodiments, the supply passage 284 communicates with the lubrication system so that a portion of the lubricant oil is supplied to this VVT mechanism 240. Because the passage portion 284*a* is formed by a drilling process in the illustrated embodiment, a closure member 290 closes one end of the passage portion 284*a*.

The first and second passages 286, 288 preferably are defined within a top portion of the camshaft 172 and the bearing cap 176. A portion of the first passage 286 includes a pathway 292 that is formed in the camshaft 172. The pathway 292 extends vertically and communicates with the pathway 278 that communicates with the ditch 272 of the first space 262. The pathway 292 also communicates with a ditch 294 that is formed in the camshaft 172. A pathway 300 is formed in the bearing cap 176. One end of pathway 300 communicates with the ditch 294, while another end of the pathway 300 communicates through port 306 with a common chamber 304 as formed in the control section 246.

A portion of the second passage 288 includes a pathway 296 that is formed in the camshaft 172. The pathway 296 extends generally vertically and communicates with the ditch 276 of the second space 264. The pathway 296 also communicates with a ditch 298 that is formed in the camshaft 172. A pathway 302 is formed in the bearing cap 176. One end of the pathway 302 communicates with the ditch 298, and another end of the pathway communicates through a port 308 with the common chamber 304.

A seal member 310 is inserted between the cylinder head assembly 108, the camshaft 172 and the bearing cap 176 to inhibit the lubricant from leaking out. It should be noted that FIGS. 7 and 9 show the delivery passages 286, 288 in a schematic fashion and that the passages 286, 288 preferably do not actually merge together.

The control section 246 preferably includes an oil control valve (OCV) 314. The OCV 314 comprises a housing section 316 and a cylinder section 318. Both the housing and cylinder sections 316, 318 preferably are positioned in the upper bearing cap 176. The sections 316, 318 preferably also extend through a hole of the camshaft cover 179. The camshaft cover preferably 179 includes a lip 319 around the opening. A bellow 320, preferably made of rubber, is provided between the housing section 316 and the lip 319 of the camshaft cover 179 to close and seal the through-hole.

The cylinder section 318 defines the common chamber 304 that communicates the supply passage 284 and the first and second delivery passages 286, 288. The cylinder section preferably includes a drain 289 that, in the illustrated arrangement, is open to the interior of the camshaft cover 179, although in other arrangements the drain 289 can be connected to other portions of the lubrication system. The housing section 316 preferably encloses a solenoid type actuator, although other types of actuators can also be used.

A rod 324 extends into the common chamber 304 from the housing 316 and is axially movable therein. The illustrated rod 324 has a first valve 326 and a second valve 328 and a pair of guide portions 330. The valves 326, 328 and the guide portions 330 have an outer diameter that is larger than an outer diameter of the rod 324 and approximately equal to an inner diameter of the cylinder 318. The rod 324 defines an internal passage 334, which extends through the rod 324, and apertures 336*a*, 336*b*, 336*c*, which communicate with the passage 334 and the common chamber 304 to allow the lubricant to escape through the drain 289 through an opening 335 as will be explained in more detail below. A coil spring 338 is retained at an end of the cylinder 318 opposite to the housing section 316 to urge the rod 324 toward the solenoid.

The solenoid actuates the rod 324 under control of the ECU so that the rod 324 can take several axial positions in the chamber 304. More specifically, the solenoid is configured to preferably push the rod 324 step by step toward certain positions as the ECU commands. If the desired position is closer to the solenoid than the present position, then the solenoid does not have to actuate the rod 324 and the coil spring 338 can push the rod 324 back to the desired position.

To direct lubricant to the first space 262, the rod 324 is moved to the left of the position shown in FIG. 9. In this position, the first passage 286 is in communication with the supply passage 284 while the second valve 328 substantially isolates the second passage 288 from the supply passage 284. In this manner, lubricant can flow into the first space 262 while the lubricant in the second space 264 can escape to the drain 289. For example, in the illustrated arrangement, the lubricant in the second passage 288 can flow into the aperture 336*c* through passage 334 and to the drain 289. To direct lubricant to the second space 264, the rod 324 is moved to the right from the position shown in FIG. 9. In this position, the second passage 288 is in communication with the supply passage 284 while the first valve 326 substantially isolates the first passage 286 from the supply passage 284. In this manner, lubricant can flow into the second space 264 while the lubricant in the first space 262 can escape through the drain 289. That is, the lubricant in the first passage 286 can flow into the aperture 336*b* and through passage 334 into the drain 289.

In the manner described above, the degree to which the inlet ports 306, 308 are closed or opened determines the amount of the lubricant that is allotted to the first and second passages 286, 288 and to the first and second spaces 262, 264 in the setting section 242 described above. The amount of the lubricant supplied to the first and second spaces 262, 264 thus determines an angular position of the camshaft 172 with respect to the intake driven sprocket 188. If more lubricant is allotted to the first space 262 than to the second space 264, the camshaft 172 is set closer to the most advanced position, and vise versa.

The operation of the illustrated VVT mechanism 240 will now be described in more detail. When the engine 32 is running, the rotation of the crankshaft 118 is transmitted to the exhaust camshaft 174 through the exhaust driven sprocket 190 and the timing chain 194. In a similar manner, the rotation of the crankshaft is also transmitted to the intake camshaft 172 through the timing chain 194, intake driven sprocket 188 and the VVT mechanism 240. Preferably, the intake and exhaust camshafts 172, 174 rotate at a predetermined speed (e.g., one half of the speed of the crankshaft 118).

As mentioned above, the outer housing 250 of the VVT mechanism 240 is coupled to and thus rotated by the intake driven sprocket 188. The rotation of outer housing 250 is transmitted to the inner rotor 252 through the lubricant in the chambers 256 of the housing 250. The inner rotor 252, in turn, is affixed to atop the intake camshaft 172 such that the rotation of the inner rotor 252 is transmitted to the intake camshaft 172. When the intake camshaft 172 is rotated, the intake valves 134 are opened and closed at an appropriate timing by the intake cams 180 formed in the intake camshaft 172. Therefore, by selectively supplying lubricant to the first and second spaces 262, 264 inside the VVT mechanism 240, the phase of the intake camshaft 172 with respect to the intake driven sprocket 188 can be adjusted and, thus, the timing of the opening and closing of the intake valves 134 can be controlled.

The control section 246 selectively supplies and removes lubricant to/from the first and second spaces 262, 264 as described above. Lubricant is supplied from the lubricant pump or an additional pump to the common chamber 304 of the control section 246 through the lubricant passages 284. From the common chamber 304, the lubricant is selectively supplied to the delivery passages 286, 288, by alternately opening and closing or by partially blocking the inlet ports 306, 308 with the rod 324 of the OCV 314. As mentioned above, the ECU controls the movement of the rod 324.

When the lubricant is supplied to the first delivery passage 286, lubricant is supplied to the first space 262 through the lubricant passages 292, 278, 270, lubricant is removed from the second space 264 and the inner rotor 252 rotates to the clockwise direction relative to the outer housing 250 as shown in FIG. 8. When lubricant is supplied to the second delivery passage 288, lubricant is supplied to the second space 264 through the lubricant passages 298, 296 274 and lubricant is removed from the first space as described above. The inner rotor 252 rotates relative to the outer housing 250 in the counterclockwise direction as shown in FIG. 6. As such, the phase of the intake camshaft 172 which rotates together with the inner rotor 252 can be adjusted and the opening-and-closing timing of the intake valves 134 can be advanced or delayed.

An advantage of the illustrated arrangement is that the since the OCV 314 is generally positioned along a substantially horizontal axis, which in the illustrated arrangement, is also generally perpendicular to the intake camshaft 172. This arrangement is advantageous for several reasons. For example, the lubricant in the lubricant system may have vapors (i.e., bubbles) mixed into the lubricant. As mentioned above, if the OCV 314 is positioned along a substantially vertical axis, these vapors can tend to rise and can be preferentially directed to one of the two supply passages 286, 288. This can alter the amount of lubricant that is supplied to the first and second spaces 262, 264, which in turn, can cause inaccuracies in the phase angle of the inner rotor 252 with respect to the outer housing 250 and the timing of the opening and closing of the intake valves 134. By arranging the common chamber and such that the inlet ports 306, 308 are located substantially at the same elevation, the lubricant supplied to the first and second spaces 262, 264 is more consistent as the vapors are not preferentially directed to either the first or the second passages 286, 288.

Another advantage of the illustrated arrangement is that, in the illustrated arrangement, the OCV 314 is positioned near the upper end of the intake camshaft 172. More preferably, the OCV 314 is positioned in the upper bearing cap 176, which supports the intake camshaft 172 and, in the illustrated arrangement, the exhaust cam shaft 174. This position reduces the distance between the OCV 314 and the setting section 242, which is located atop the intake cam shaft 172. As such, the length of the various lubricant passages, which preferably are also located in the upper bearing cap 176, of the fluid supply section 244 can be reduced. The shortened distances increases the responsiveness of the VVT 240 to the position changes of the OCV 314.

Another advantage of the illustrated arrangement is that the OCV 314 positioned generally along an axis that extends across the engine 32 from the right side to the left side. This provides for a compact size of the engine 32.

In the illustrated embodiment, the VVT mechanism 240 is formed on the intake camshaft and is not formed on the exhaust camshaft. It should be understood, however, that a VVT mechanism 240 can also be formed on the exhaust camshaft, so that both the intake and exhaust camshafts have a VVT mechanism.

Figure 10:
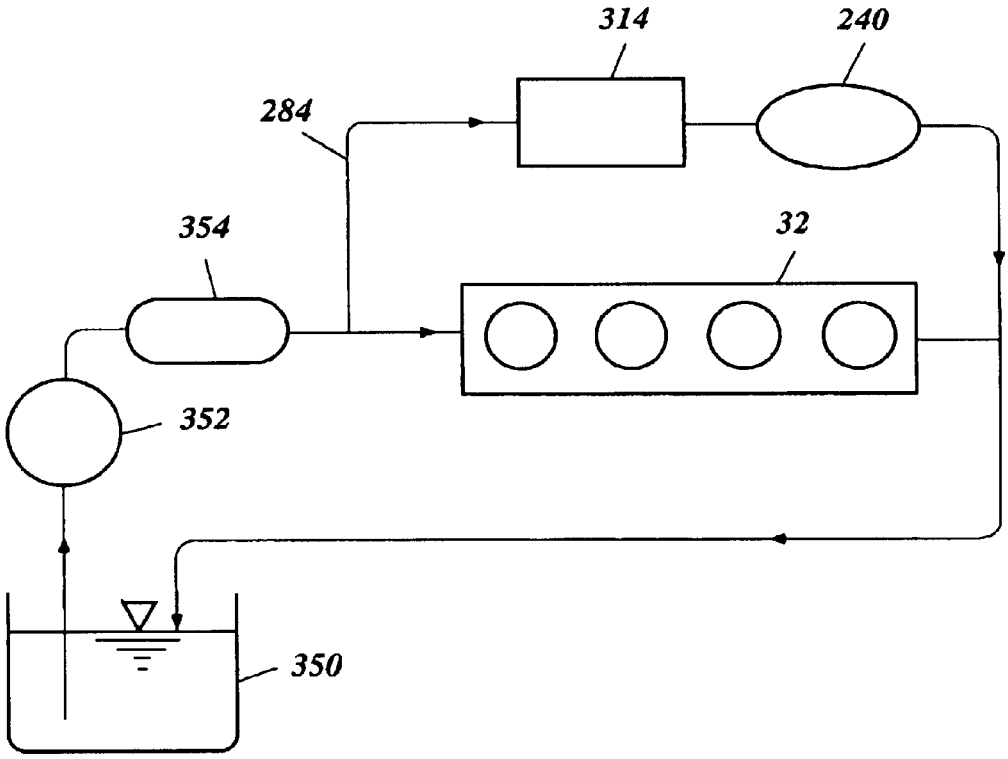
FIG. 10 is a schematic view of an engine lubrication system and VVT mechanism.

With next reference to FIG. 10, an embodiment of an oil delivery system for both the VVT mechanism 240 and the engine lubrication system is schematically shown. As discussed above, a main lubricant reservoir 350 of the lubrication system is typically positioned within the drive shaft housing 54. An oil pump 352 is located, for example, atop the drive shaft housing 54, and pressurizes the lubricant. After passing the pressurized oil through a filter 354, a portion of the oil is directed to the engine 32 to lubricate selected portions and components of the engine 32. Another portion of the oil is directed to supply passage 284 and further to the oil control valve (OCV) 314, which selectively directs oil flow into the VVT mechanism 240 in order to control the VVT mechanism 240. Oil from both the VVT mechanism 240 and the engine 32 then flows back to the reservoir 350 to be circulated again.

Figure 11:
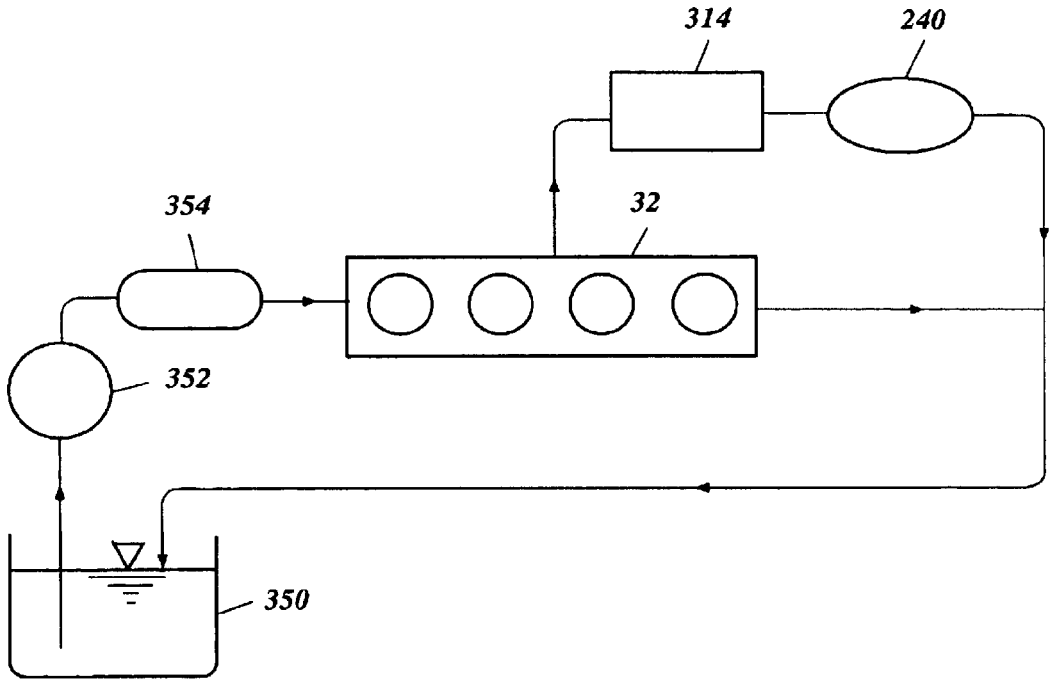
FIG. 11 is a schematic view of another engine lubrication system and VVT mechanism.

FIG. 11 shows another, similar embodiment wherein the oil is first delivered to the engine 32, then to the OCV 314. After passing through at least a portion of the engine 32, oil is supplied to the OCV 314 and then into the VVT mechanism 240. Both of the embodiments shown in FIGS. 10 and 11 have a problem of delayed responsiveness of the VVT mechanism 240, because a passage from the oil pump 352 to the OCV 314 is relatively long. Because of this delayed responsiveness, the hydraulic pressure directing the VVT mechanism 240 cannot be stabilized, and performance of the VVT mechanism 240 suffers.

Figure 12:
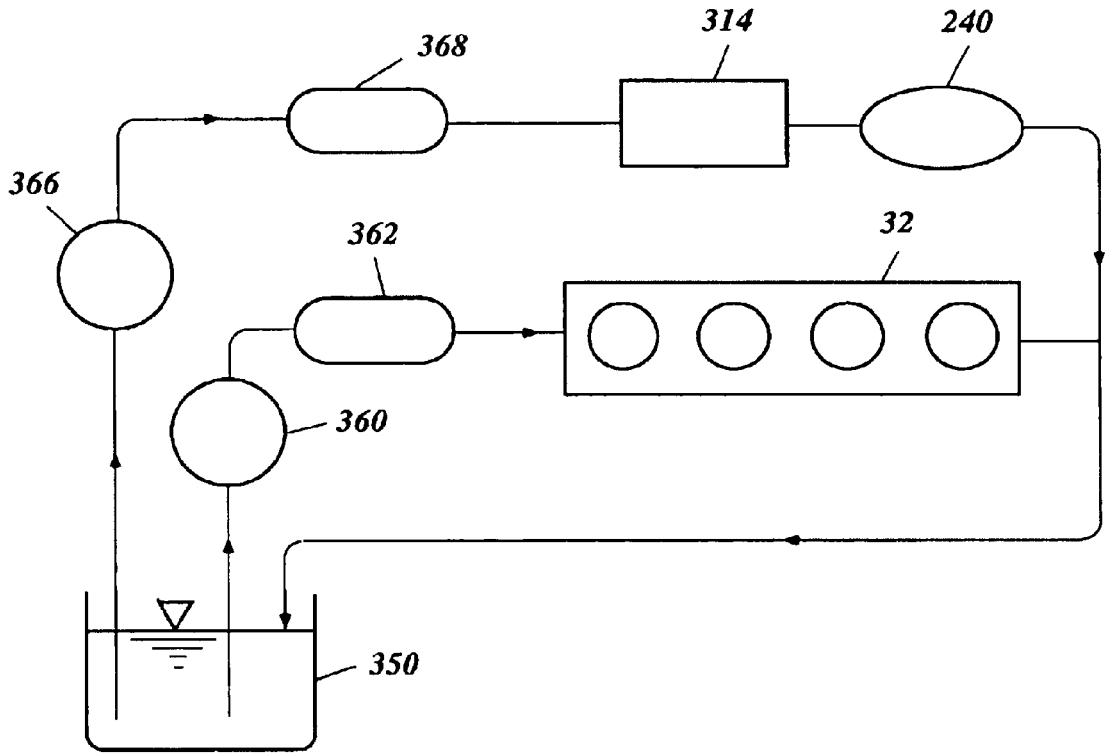
FIG. 12 is a schematic view of still another embodiment of an engine lubrication system and VVT mechanism.
Figure 13:
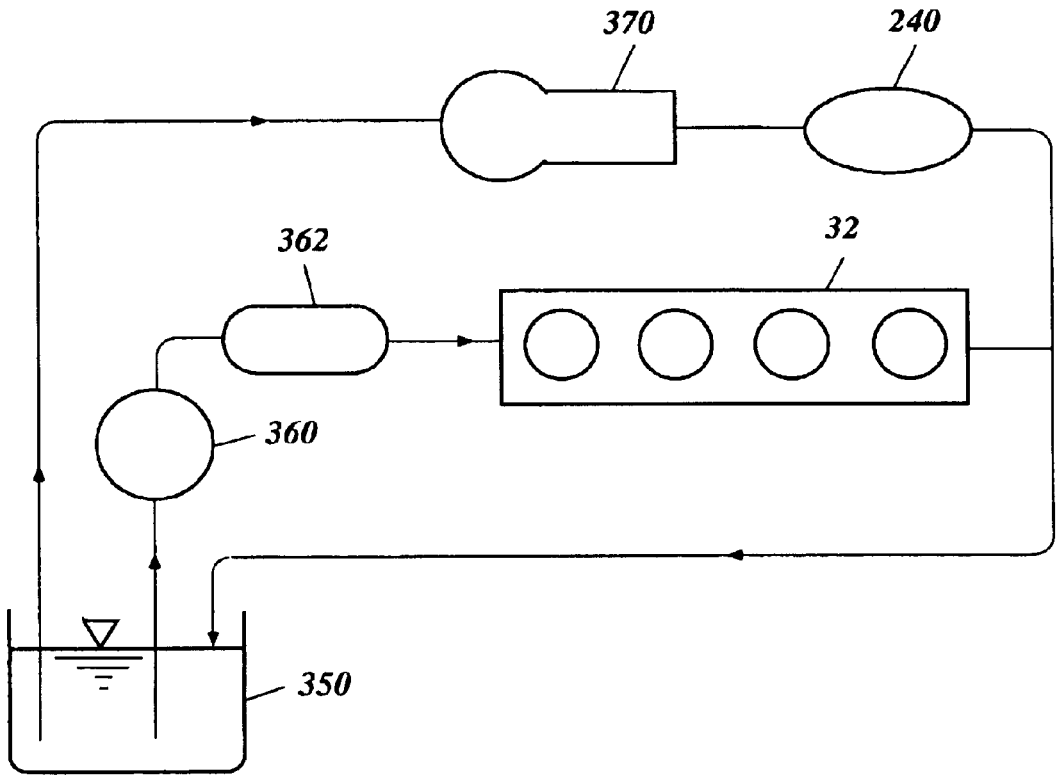
FIG. 13 is a schematic view of yet another embodiment of an engine lubrication system and VVT mechanism.

With reference next to FIGS. 12 and 13, an additional embodiment is shown wherein the VVT mechanism 240 and the engine lubrication system are supplied oil in a parallel arrangement. As shown in FIG. 12, oil is collected in a main oil reservoir 350 and is drawn by a dedicated lubricant system oil pump 360 through a filter 362 and into the engine 32 to lubricate various engine components. After passing through the engine, the oil is drained back to the oil reservoir 350. A dedicated VVT oil pump 366 also draws oil from the reservoir 350 and directs the oil through a dedicated VVT filter 368, from which the oil is directed to the OCV 314. The OCV 314 selectively directs the oil into the VVT mechanism 240 to control the VVT mechanism. After passing through the VVT mechanism 240, the oil drains back to the reservoir 350.

In the embodiment illustrated in FIG. 12, the pressurization of oil for the VVT mechanism 240 is provided separately from the pressurization of oil for the lubrication system. With such a parallel arrangement, the dedicated VVT oil pump 366 can be positioned anywhere on the outboard motor 30, and can be located closer to the OCV 314 than can the lubricant system oil pump 360. For example, the VVT oil pump 366 can be positioned immediately adjacent the OCV 314. Also, since the dedicated VVT oil pump 366 supplies oil only to the VVT mechanism 240, pressure variations that may result from supplying oil to multiple systems, such as both the VVT mechanism 240 and the lubrication system, are eliminated, and responsiveness and consistency are increased. This arrangement allows increased responsiveness and thus increased hydraulic stability in control of the VVT mechanism 240.

The dedicated VVT oil pump 366 shown in FIG. 12 can comprise any suitable pump such as, for example, a roller vane-type electromagnetic pump. Also, since the dedicated VVT pump 366, VVT filter 368, and OCV 314 are each dedicated to hydraulically controlling the VVT mechanism 240, these components collectively can be considered a VVT hydraulic unit 370. Additionally, these components can be positioned immediately adjacent to each other, and can even be installed or mounted together as an integral unit. FIG. 13 shows the same embodiment as shown in FIG. 12, with the pump 366, filter 368 and OCV 314 collectively represented as a VVT hydraulic unit 370.

Figure 14:
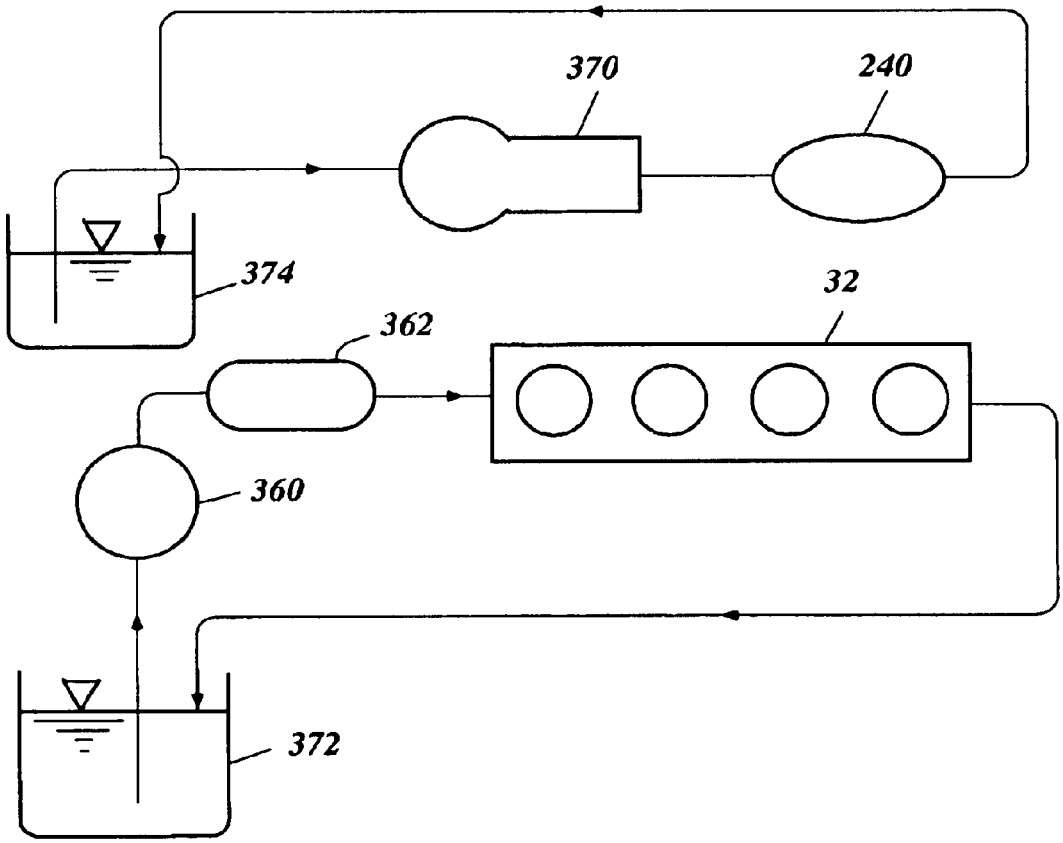
FIG. 14 is a schematic view of a further embodiment of an engine lubrication system and VVT mechanism.

With reference next to FIG. 14, another preferred embodiment comprises totally independent systems for hydraulically controlling the VVT mechanism 240 and lubricating the engine 32. As shown in the figure, the lubrication system includes a dedicated lubricant system reservoir 372 from which a lubricant system oil pump 360 draws oil. The pressurized oil is directed through an oil filter 362 and into the engine 32 in order to lubricate engine components. The oil drains from the engine 32 back to the lubricant reservoir 372.

The VVT hydraulic system of FIG. 14 comprises a dedicated VVT hydraulic fluid reservoir 374. A VVT control unit 370, which comprises a pump, filter and control valve, draws fluid from the VVT reservoir 374 and supplies the hydraulic fluid to the VVT mechanism 240 in order to control and operate the mechanism. After flowing through the VVT mechanism 240, the hydraulic fluid is drained back to the reservoir 374. In this embodiment, as with the embodiment of FIGS. 12 and 13, the VVT pump of the control unit 370 can be positioned and arranged in such a manner so that the flow of hydraulic fluid is highly responsive to controls. Thus, the VVT mechanism 240 can be controlled with precision.

In the embodiment illustrated in FIG. 14, both the VVT system and the engine lubrication system can use lubricant oil. It is to be understood, however, that the VVT control system can also employ other fluids, such as commercial-grade hydraulic fluids.

Figure 15:
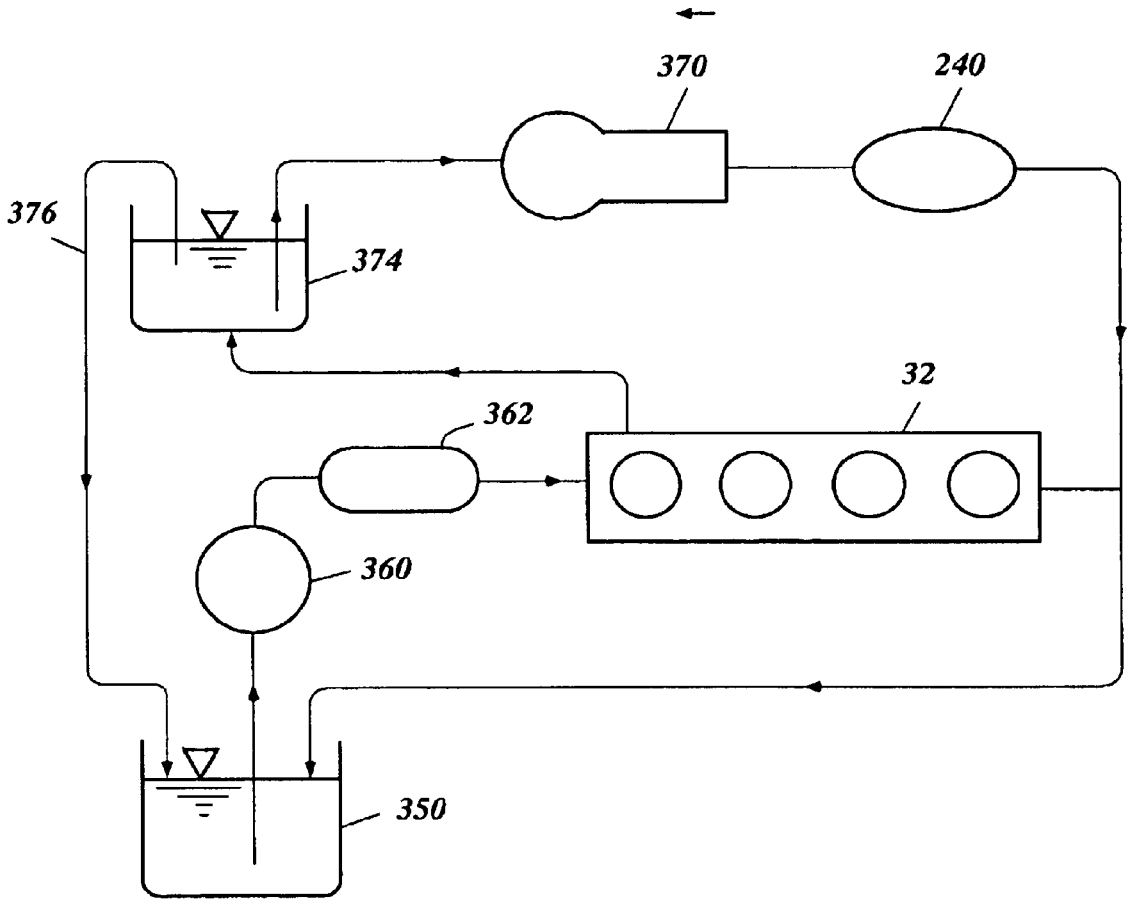
FIG. 15 is a schematic view of yet a further embodiment of an engine lubrication system and VVT mechanism.

With next reference to FIG. 15, in yet another preferred embodiment, the lubrication system and VVT control system share some components, yet still operate substantially independently from one another. In this embodiment, the VVT unit 370 draws oil from a VVT oil reservoir 374 and delivers the oil to the VVT mechanism 240 in order to appropriately control the VVT mechanism 240. From the VVT mechanism 240, the oil drains to a main reservoir 350. A lubricant system oil pump 360 draws oil from the main reservoir 350, passes the pressurized oil through a filter 362 and delivers it to the engine 32 for lubrication of engine components. A portion of the oil from the engine 32 drains back to the main reservoir 350, and a portion of the oil is directed to the VVT reservoir 374. Thus, a continuous flow of oil is supplied to the VVT reservoir 374 from the engine 32. An overflow passage 376 is provided from the VVT reservoir 374 to the main reservoir 350 so that the volume of oil retained in the VVT reservoir 374 never exceeds the reservoir's capacity With reference next to FIG. 16, a still further embodiment is shown. An oil pump 352 draws lubricant from a main lubricant reservoir 350. The lubricant is pressurized by the oil pump 352 and passes through a filter 354. A portion of the oil is directed to the engine 32, and another portion of the oil is directed by a branch passage to a supplemental oil pump 378. The supplemental oil pump 378 again pressurizes the lubricant and supplies the pressurized lubricant to the OCV 314 which, in turn, supplies lubricant to control the VVT mechanism 240. Excess lubricant drains back to the main reservoir 350

Figure 16:
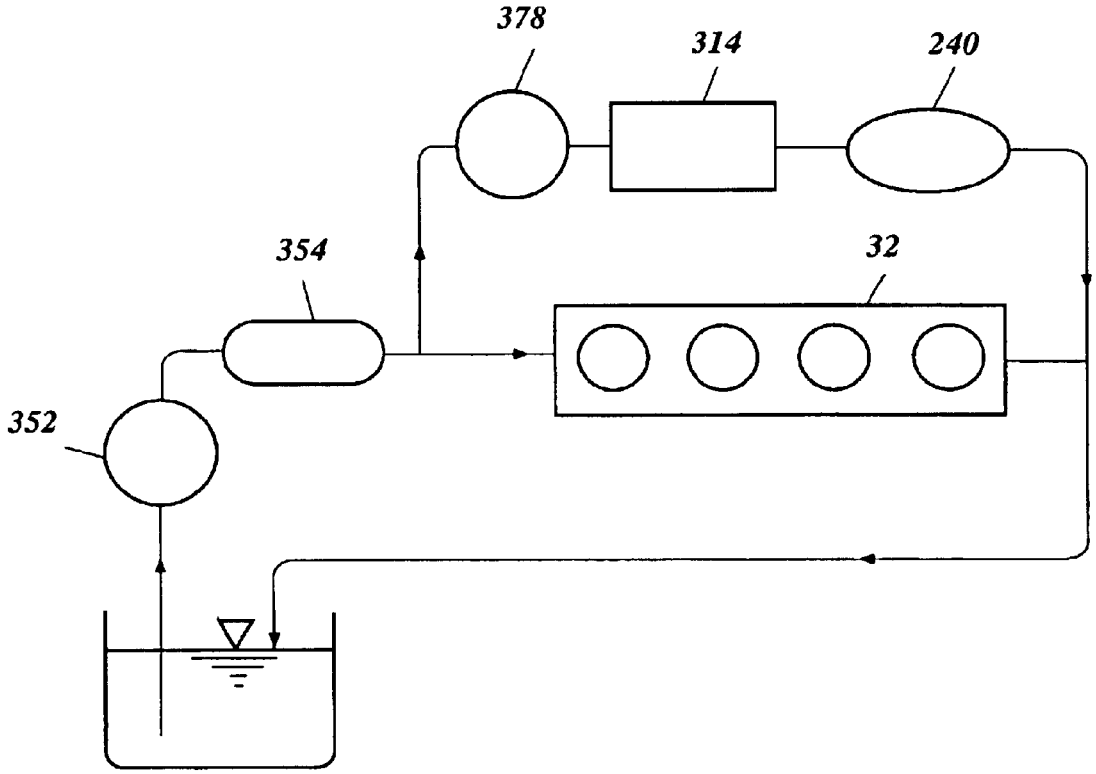
FIG. 16 is a schematic view of still a further embodiment of an engine lubrication system and VVT mechanism.

As illustrated in FIG. 16, the oil pump 352 and supplemental oil pump 378 are arranged in series, but the VVT mechanism 240 and engine are arranged in parallel. The supplemental pump 378 can be mounted immediately adjacent or integrally with the OCV 314, and oil pressure can be consistently maintained at an optimum level so as to maximize hydraulic stability during operation of the VVT mechanism 240.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A four-cycle engine comprising an engine body, at least one cylinder, a piston reciprocatingly arranged in the cylinder, and a cylinder head assembly, a combustion chamber being defined between the cylinder head assembly, cylinder and piston, a port opening into the combustion chamber, a valve selectively opening and closing the port, a camshaft having a cam configured to actuate the valve, a variable valve timing mechanism configured to vary the valve timing of the valve by varying an angular position of the camshaft, a fluid pump adapted to provide fluid under pressure to a control valve, the control valve being configured to selectively supply fluid to the variable valve timing mechanism so as to control the angular position of the camshaft, and an engine lubrication system having an oil reservoir and an oil pump, the oil pump drawing oil from the oil reservoir, and the fluid pump and oil pump operate substantially independently from one another.

2. A four-cycle engine as in claim 1, wherein the fluid pump draws oil from the oil reservoir.

3. A four-cycle engine as in claim 2, wherein an oil path between the fluid pump and the control valve is shorter than an oil path between the oil pump and the control valve.

4. A four-cycle engine as in claim 3, wherein the fluid pump is mounted immediately adjacent the control valve.

5. A four-cycle engine as in claim 1 additionally comprising a hydraulic fluid reservoir, and the fluid pump draws hydraulic fluid from the hydraulic fluid reservoir.

6. A four-cycle engine as in claim 5, wherein the hydraulic fluid is not mixed with oil from the engine lubrication system.

7. A four-cycle engine as in claim 6, wherein the fluid comprises oil.

8. A four-cycle engine as in claim 5, wherein the oil pump supplies oil to the engine body, and additionally comprising an oil passage from the engine body to the fluid reservoir, wherein at least a portion of oil from the engine body flows to the hydraulic fluid reservoir.

9. A four-cycle engine as in claim 8 additionally comprising an overflow drain passage extending from the hydraulic fluid reservoir to the oil reservoir.

10. A four-cycle engine as in claim 1 additionally comprising a substantially vertical crankshaft communicating with the piston through a connection rod, wherein the engine is configured to drive a marine propulsion device.

11. A four-cycle engine as in claim 1, wherein the fluid pump provides fluid under pressure to the control valve while the engine is running.

12. A four-cycle engine as in claim 11, wherein the oil pump does not supply any fluid under pressure to the control valve.

13. A four-cycle engine comprising an engine body defining at least one cylinder having a piston arranged to reciprocate therein, a cylinder head attached to the engine body, a combustion chamber defined between the cylinder, piston and cylinder head, a port opening into the combustion chamber, a valve mechanism configured to selectively open and close the port, a camshaft having a cam lobe configured to actuate the valve mechanism, a variable valve timing mechanism cooperating with the camshaft, the variable valve timing mechanism configured to selectively vary the angular position of the camshaft in response to hydraulic fluid inputs supplied by a driving system, the driving system comprising a hydraulic fluid pump and a control valve, and a lubrication system configured to supply lubricant oil to the engine body, the lubrication system comprising an oil pump and an oil reservoir, and pressurization of fluid by the hydraulic fluid pump is provided separately from pressurization of oil by the oil pump.

14. A four-cycle engine as in claim 13, wherein the driving system is defined by a closed loop comprising the hydraulic fluid pump, a hydraulic fluid reservoir, the control valve, and the variable valve timing mechanism.

15. A four-cycle engine as in claim 14, wherein the lubrication system is defined by a closed loop comprising the oil pump, the oil reservoir and the engine body.

16. A four-cycle engine as in claim 15, wherein the hydraulic fluid of the driving system comprises oil.

17. A four-cycle engine as in claim 13, wherein the hydraulic fluid pump is configured to draw oil from the oil reservoir.

18. A four-cycle engine as in claim 13, wherein the hydraulic pump comprises an electromagnetic pump.

19. A four-cycle engine as in claim 13, wherein the hydraulic pump is mounted to the control valve.

20. A four-cycle engine as in claim 13, wherein the driving system is configured so that the hydraulic pump draws oil from a hydraulic fluid reservoir, and oil from the variable valve timing mechanism drains to the oil reservoir, and the lubrication system is configured so that a portion of oil drains from the engine body to the hydraulic fluid reservoir.

21. A four-cycle engine as in claim 20, additionally comprising a passage from the hydraulic fluid reservoir to the oil reservoir.

22. A four-cycle engine as in claim 13, wherein the driving system supplies hydraulic fluid inputs to the variable valve timing mechanism while the engine is running.

* * * * *

UNITED STATES PATENT AND TRADEMARK OFFICE

CERTIFICATE OF CORRECTION

PATENT NO. : 6,752,108 B2
APPLICATION NO. : 09/870618
DATED : June 22, 2004
INVENTOR(S) : Goichi Katayama It is certified that error appears in the above-identified patent and that said Letters Patent is hereby corrected as shown below:

At Column 8, Line 51, SPECIFICATION, after “quickly” insert --.--.

At Column 16, Line 13, after “capacity” insert --.--.

At Column 16, Line 24, after “350” insert --.--.

At Column 18, Line 37, in Claim 21, delete “claim 20,” and insert --claim 20--, therefor.

At Column 18, Line 38, in Claim 21, delete “passage” and insert --passageway--, therefor.

Signed and Sealed this

Fifth Day of December, 2006

JON W. DUDAS
*Director of the United States Patent and Trademark Office*